US012716251B2

(12) United States Patent
Horn et al.

(10) Patent No.: US 12,716,251 B2
(45) Date of Patent: Aug. 25, 2026

(54) SIDING INSTALLATION APPARATUS

(71) Applicant: GENERAL TOOLS & INSTRUMENTS COMPANY LLC, Secaucus, NJ (US)

(72) Inventors: Timothy Horn, Columbus, OH (US); Cory Shoup, Powell, OH (US); Joel Vangilder, Columbus, OH (US)

(73) Assignee: General Tools & Instruments Company LLC, Seacaucus, NJ (US)

( * ) Notice: Subject to any disclaimer, the term of this patent is extended or adjusted under 35 U.S.C. 154(b) by 338 days.

(21) Appl. No.: 18/601,368

(22) Filed: Mar. 11, 2024

(65) Prior Publication Data

US 2025/0283339 A1 Sep. 11, 2025

(51) Int. Cl.
*E04G 21/16* (2006.01)

(52) U.S. Cl.
CPC ..... *E04G 21/167* (2013.01)

(58) Field of Classification Search
CPC ..... E04G 21/167
USPC ..... 33/646, 647, 648, 649
See application file for complete search history.

(56) References Cited

U.S. PATENT DOCUMENTS 370,019 A * 9/1887 Moberg ..... E04F 21/1855 33/646
1,031,854 A * 7/1912 Keyes ..... E04F 21/1855 7/122
4,819,475 A * 4/1989 Irvello ..... E04F 21/1855 83/522.18
4,879,818 A * 11/1989 Beaulieu ..... G01B 3/30 33/646
5,522,149 A * 6/1996 Meyer ..... E04F 21/1855 33/646
5,692,311 A * 12/1997 Paquin ..... E04D 15/04 33/647
5,768,830 A * 6/1998 Kelly ..... F16M 11/24 52/127.2
6,901,681 B2 * 6/2005 Bueno ..... E04D 15/025 33/646
7,168,181 B2 * 1/2007 Walchak ..... B25B 5/068 269/36
7,240,435 B1 * 7/2007 Dowdakin ..... E04F 21/0015 33/194

(Continued)

FOREIGN PATENT DOCUMENTS

WO WO-2008124527 A1 * 10/2008 ..... E04F 19/024

OTHER PUBLICATIONS https://pactool.us/gecko-gauge-model-sa903; 6 pages; Jun. 14, 2024.

(Continued)

*Primary Examiner* — George B Bennett
(74) *Attorney, Agent, or Firm* — TUCKER ELLIS LLP

(57) ABSTRACT

Provided is a siding gauge including a housing having a through passage extending along its length, a support arm movable relative to the housing in the through passage, the support arm including a body and a pair of legs extending from the body, the pair of legs being laterally spaced from one another to define a channel and each having an angled surface, a lever pivotable relative to the housing, and a pressure plate positioned in the through passage and coupled to the housing by a fastener, the pressure plate having an angled surface to correspond to the angled surface of the pair of legs.

20 Claims, 13 Drawing Sheets

(56) References Cited

U.S. PATENT DOCUMENTS

| | | | | |
|---|---|---|---|---|
| 7,434,329 | B2 * | 10/2008 | Walda | E04F 21/1855 52/794.1 |
| 7,546,692 | B2 * | 6/2009 | Simko | E04F 21/1855 33/647 |
| 7,584,587 | B2 * | 9/2009 | Ouellette | E04F 13/0889 52/749.1 |
| 9,951,534 | B2 * | 4/2018 | Menges | E04F 21/1855 |
| 10,968,642 | B1 * | 4/2021 | Rasmussen | E04F 21/1855 |
| 2009/0107084 | A1 * | 4/2009 | Hutchings | E04F 21/1855 52/749.1 |
| 2013/0031867 | A1 * | 2/2013 | Duquette | E04F 21/1855 52/749.11 |
| 2016/0060883 | A1 * | 3/2016 | Fetterman | E04F 21/1855 33/613 |
| 2020/0299975 | A1 * | 9/2020 | Grenon | E04F 21/1883 |

OTHER PUBLICATIONS https://pactool.us/pactool/siding-tools/gecko-gauge/gecko-gauge-sa902; 6 pages; Jun. 14, 2024.

https://www.amazon.com/Saker-Adjustable-Install-Tool-Mounting-Installation/dp/B0BV7YVHJX/ref=asc_df_B0BV7YVHJX/?tag=hyprod-20&linkCode=df0&hvadid=693270340248&hvpos=&hvnetw=g&hvrand=15997302691818469620&hvpone=&hvptwo=&hvqmt=&hvdev=c&hvdvcmdl=&hvlocint=&hvlocphy=9058761&hvtargid=pla-2245699795571&psc=1&mcid=5f84d976c0b33d0e95d8afea79fdad55&gad_source=1; 10 pages; Jun. 14, 2024.

https://www.amazon.com/Malco-SGA-Adjustable-Siding-Gauge/dp/B0BPYQGLZT?source=ps-sl-shoppingads-Ipcontext&ref_=fplfs&psc=1&smid=A37KLPQG0QTZGU; 8 pages; Jun. 14, 2024.

https://www.amazon.com/SoloSider-Siding-Cement-Smartside-Adjustable/dp/B000HVEVX4; 8 pages; Jun. 14, 2024.

* cited by examiner

SIDING INSTALLATION APPARATUS

TECHNICAL FIELD

In general, the present invention relates to a siding installation apparatus, and in particular to a siding gauge for hanging siding.

BACKGROUND OF THE INVENTION

Exterior surfaces of houses and other structures are often protected by exterior siding products made from wood, vinyl, aluminum, bricks, stucco, fiber-cement, and other materials. Composite materials, such as engineered wood and fiber-cement siding products, for example, include panels, planks, and shakes that are installed on plywood or composite walls. To install these siding products, tools have been developed to support a siding during installation.

SUMMARY OF THE INVENTION

According to an aspect, a siding gauge is provided that includes a housing having a through passage extending along its length, a first opening in a front of the housing into the through passage, and a second opening in a rear of the housing into the through passage and aligned with the first opening, a support arm movable relative to the housing in the through passage, the support arm including a body and a pair of legs extending from the body, the pair of legs being laterally spaced from one another to define a channel and each having an angled surface, a fastener received in the first and second openings, and a pressure plate positioned in the through passage and coupled to the housing by the fastener, the pressure plate having an angled surface to correspond to the angled surface of the pair of legs, wherein interaction between the angled surface of each of the pair of legs and the angled surface of the pressure plate increases a retention force of the fastener in a primary load direction.

According to another aspect, a siding gauge is provided that includes a housing having a through passage extending along its length, a support arm movable relative to the housing in the through passage for adjusting a reveal height, and a lever pivotable relative to the housing, the lever movable between a first upward closed position to clamp the siding gauge against the siding, a second downward closed position to clamp the siding gauge against the siding, and an open position between the first upward closed position and the second downward closed position to provide slack for positioning the siding gauge.

According to still another aspect, a siding gauge is provided that includes a housing having a through passage extending along its length, a first opening in a front of the housing into the through passage, a second opening in the front of the housing into the through passage, a third opening in a rear of the housing into the through passage and aligned with the first opening, and a fourth opening in the rear of the housing into the through passage and aligned with the second opening, a support arm movable relative to the housing in the through passage, the support arm including a body and a pair of legs extending from the body, the pair of legs being laterally spaced from one another to define a channel, a lever pivotable relative to the housing, a retention clip coupled to the housing and movable relative to the housing for adjusting for siding thickness, a first fastener received in the first and third openings for adjusting a reveal height of the support arm, and a second fastener received in the second and fourth openings for pivotally coupling the lever to the housing.

These and other objects of this application will be evident when viewed in light of the drawings, detailed description and appended claims.

DETAILED DESCRIPTION OF THE INVENTION

Figure 1:
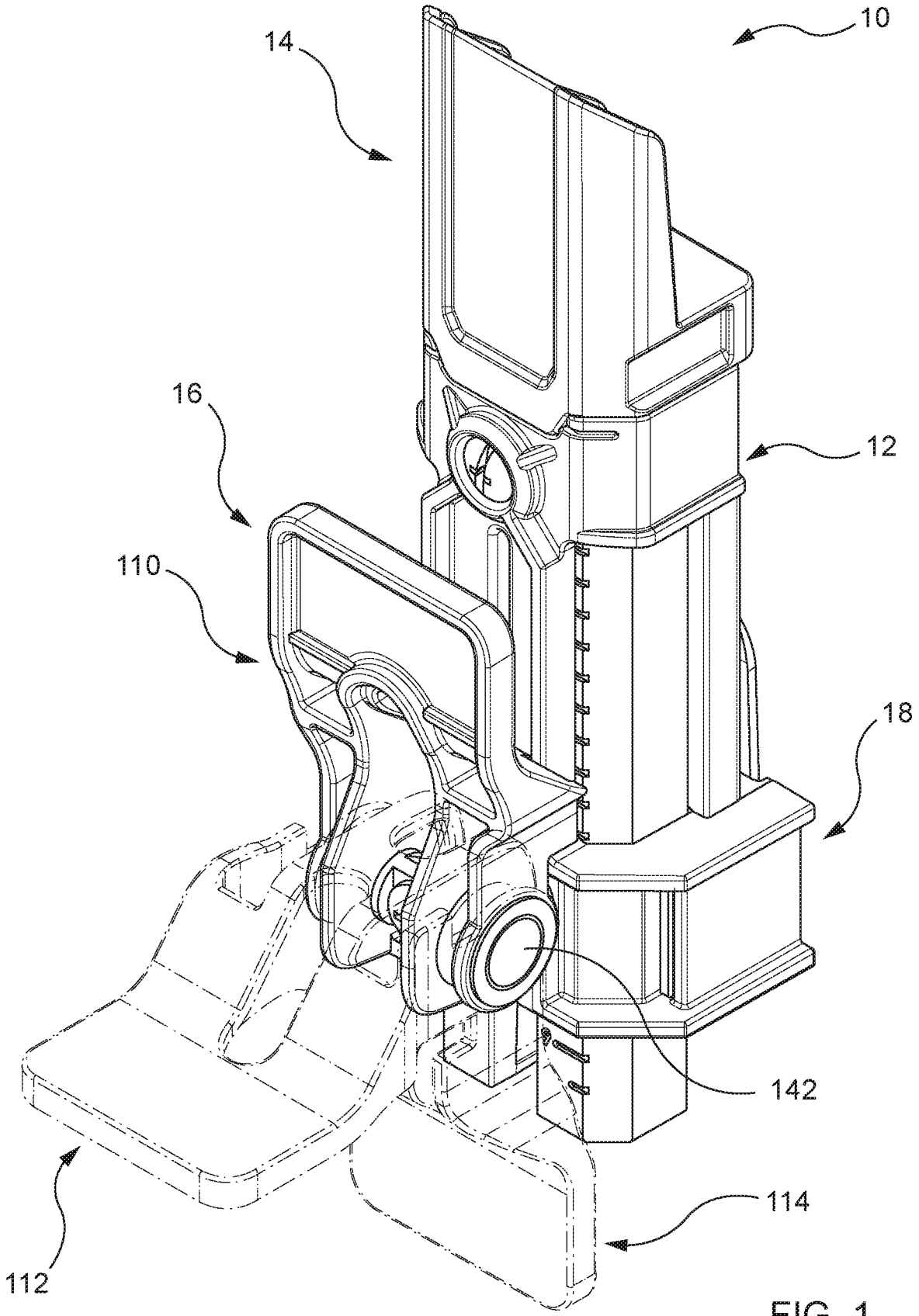
FIG. 1 is a perspective view of an exemplary siding gauge.
Figure 2:
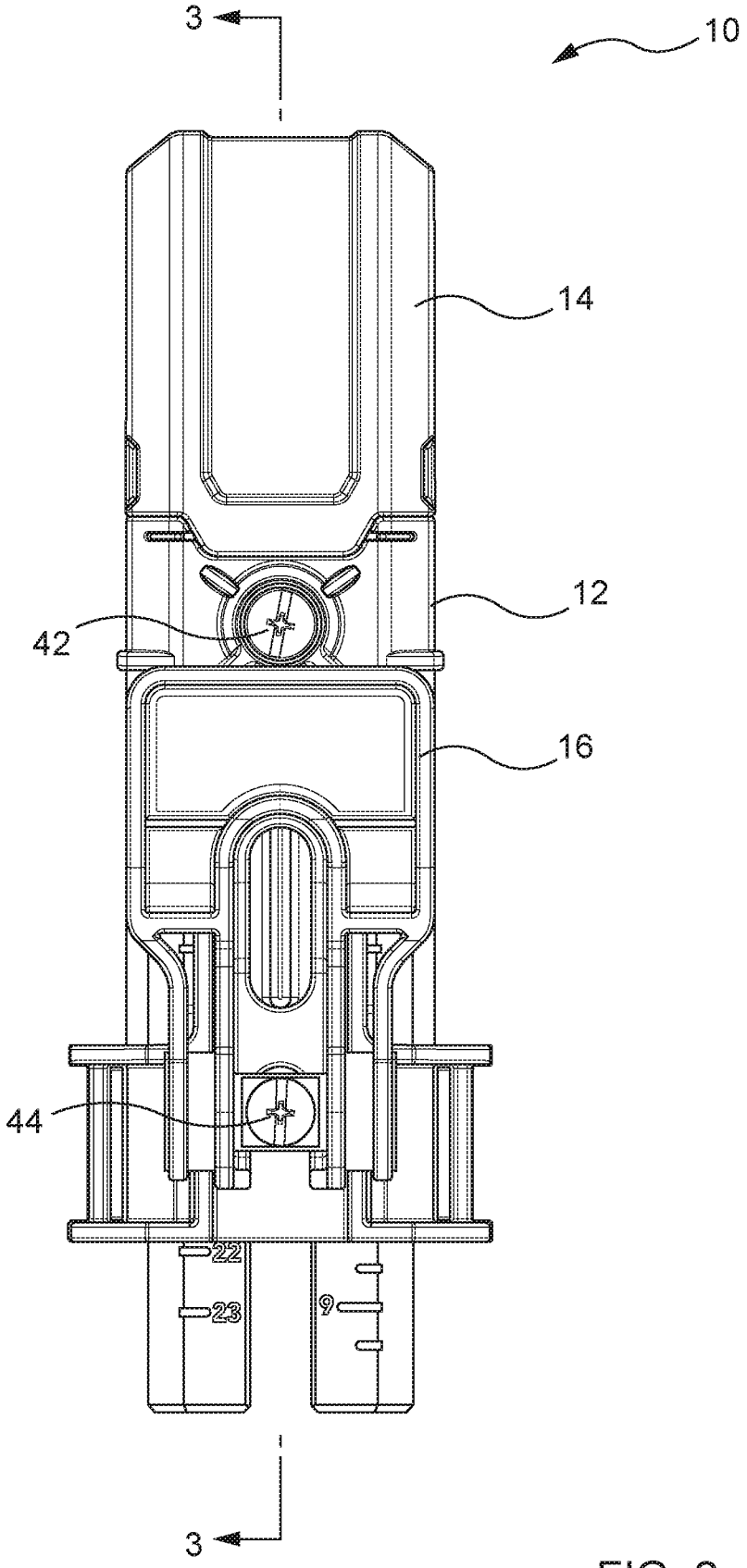
FIG. 2 is front view of the siding gauge.

Embodiments of the application relate to methods and systems that relate to a siding gauge. The siding gauge includes a housing having a through passage extending along its length, a first opening in a front of the housing into the through passage, a second opening in the front of the housing into the through passage, a third opening in a rear of the housing into the through passage and aligned with the first opening, and a fourth opening in the rear of the housing into the through passage and aligned with the second opening, a support arm movable relative to the housing in the through passage, the support arm including a body and a pair of legs extending from the body, the pair of legs being laterally spaced from one another to define a channel, a lever pivotable relative to the housing, a retention clip coupled to the housing and movable relative to the housing for adjusting for siding thickness, a first fastener received in the first and third openings for adjusting a reveal height of the support arm, and a second fastener received in the second and fourth openings for pivotally coupling the lever to the housing. The siding gauge can also include a pressure plate positioned in the through passage and coupled to the housing by the first fastener, wherein each of the pair of legs of the support arm has an angled surface and wherein the pressure plate is angled to correspond to the angled surface of the pair of legs. The lever may be movable between a first closed position to clamp the siding gauge against the siding, an open position to provide slack form positioning the siding gauge, and a second closed position to clamp the siding gauge against the siding.

With reference to the drawings, like reference numerals designate identical or corresponding parts throughout the several views. The inclusion of like elements in different views does not mean a given embodiment necessarily includes such elements or that all embodiments of the application include such elements. The examples and figures are illustrative only and not meant to limit the application, which is measured by the scope and spirit of the claims.

Turning now to FIGS. 1-4, a siding gauge is shown generally at reference numeral 10. The siding gauge includes a housing 12, a support arm 14 movable relative to the housing 12 to accommodate siding of different heights and vertical spacings, a lever 16 pivotable relative to the housing 12 to engage/disengage the siding gauge, and a retention clip 18 movable relative to the housing 12 to accommodate siding of different thicknesses. The housing 12, support arm 14, and lever 16 may be made of a suitable material, such as plastic to avoid marring of the siding, and the retention clip 18 may be made of a suitable material, such as chrome plating to avoid marring the siding.

Figure 5:
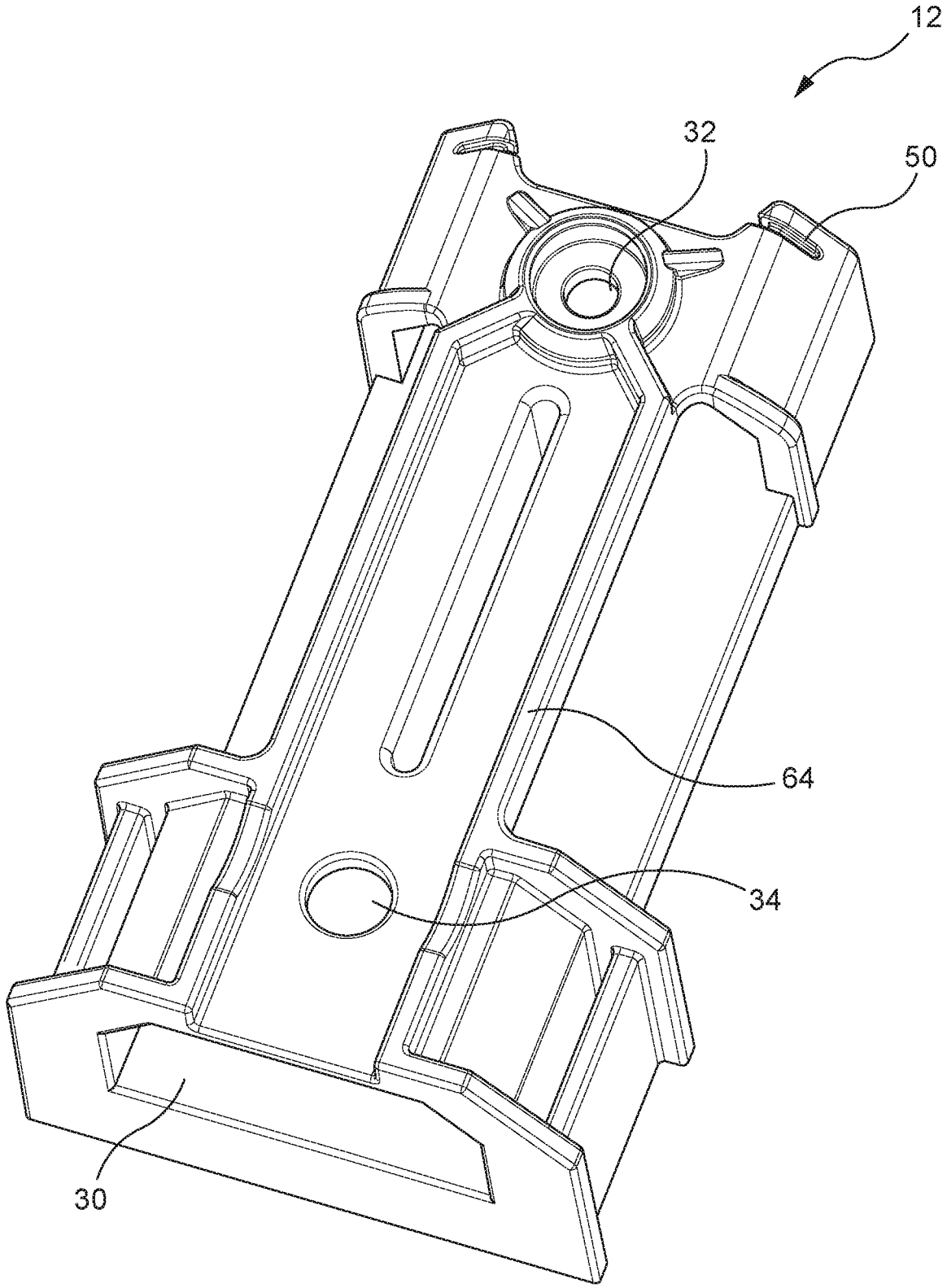
FIG. 5 is a perspective view of a housing of the siding gauge.
Figure 6:
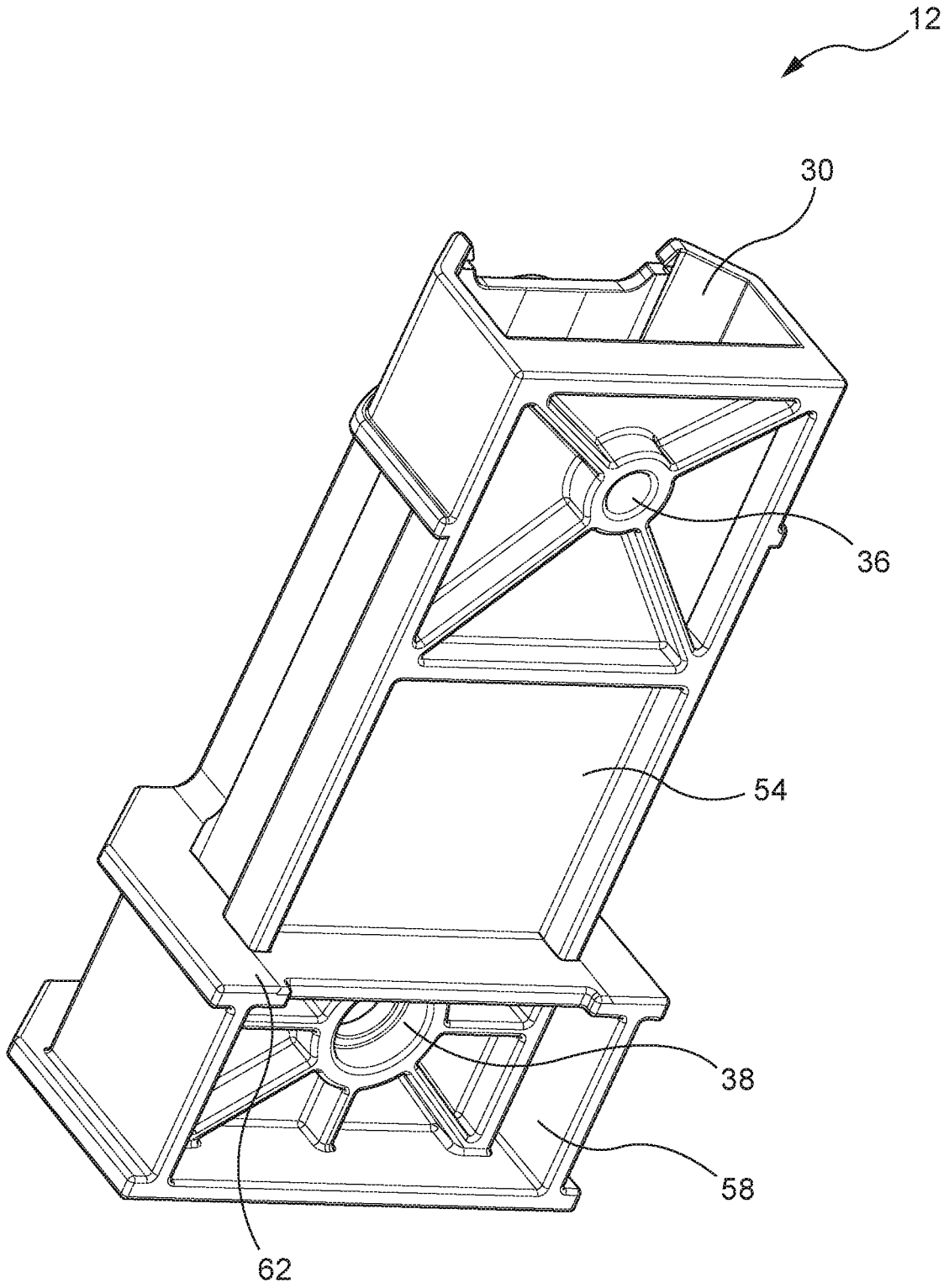
FIG. 6 is another perspective view of the housing.
Figure 7:
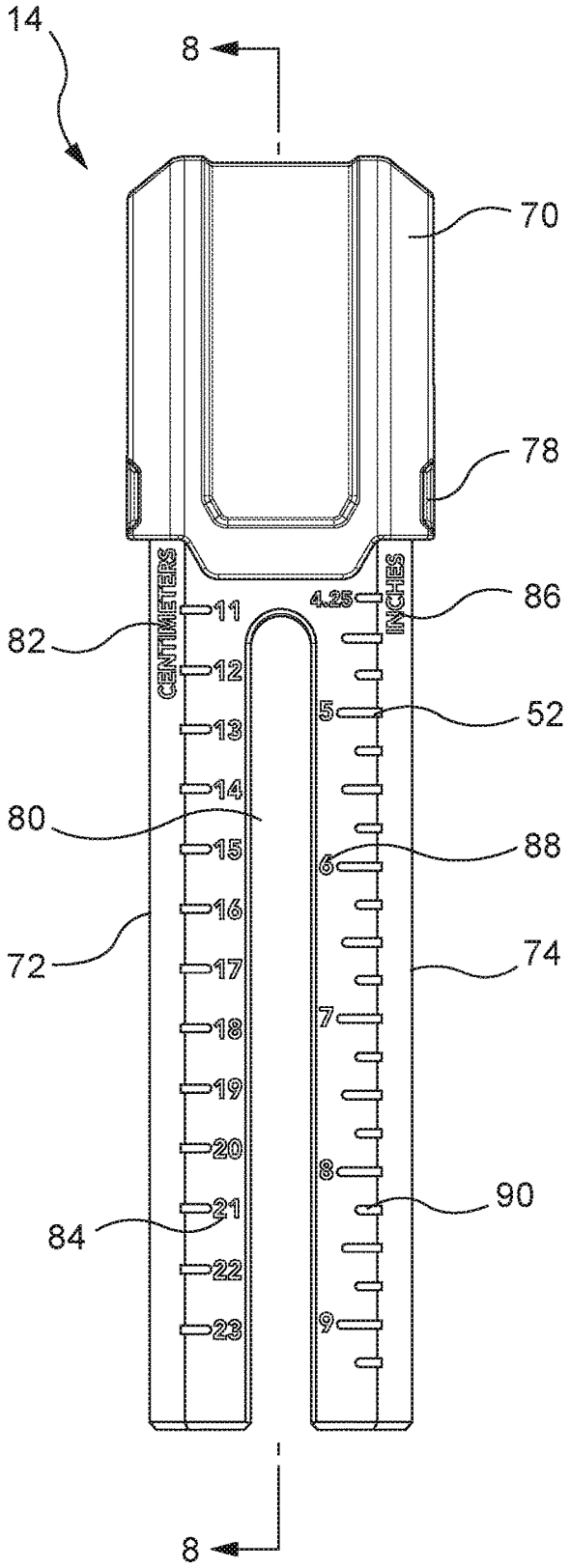
FIG. 7 is a front view of a support arm.

Turning additionally to FIGS. 5 and 6, the housing 12 includes a through passage 30 extending along its length for receiving the support arm 14, first and second openings 32 and 34 extending through front of the housing 12 into the passage 30, third and fourth openings 36 and 38 extending through a back of the housing 12 into the passage 30 aligned with the first and second openings 32 and 34 respectively, and a guide 40 in the passage 30 to guide and maintain orientation of the support arm 14. The first and third openings 32 and 36 are configured to receive a first fastener 42 perpendicular to or substantially perpendicular to an axis of the passage 30. The second and fourth openings 34 and 38 are configured to receive a second fastener 44 perpendicular to or substantially perpendicular to the axis of the passage 30, and the fourth opening 38 is also configured to receive a fastener retainer 46 that couples to the fastener 44.

The front of the housing 12 includes markings or indicia, such as indents 50 at the top of the front serving as measurement guide markers for aligning with markings or indicia, such as indents 52 on the support arm 14 serving as reveal measurement guides. The back of the housing 12 defines a cavity 54 for receiving a pad 56, a cavity 58 for receiving arms 60 of the retention clip 18, and includes one or more non-marring contact surfaces, such as surface 62 that contacts the siding. The pad 56 may be a rubber pad that abuts a front of the siding during use to prevent marring and increasing clamping friction, and is configured to deform when the lever is moved to one of the closed positions.

Figure 8:
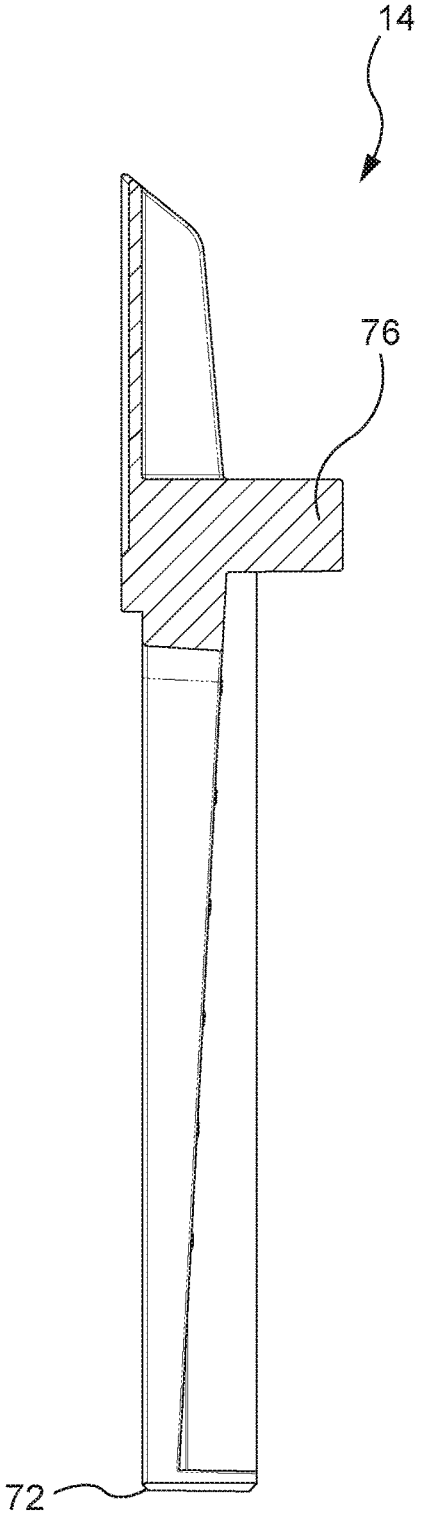
FIG. 8 is a cross-sectional view taken about line 8-8 in FIG. 7.
Figure 9:
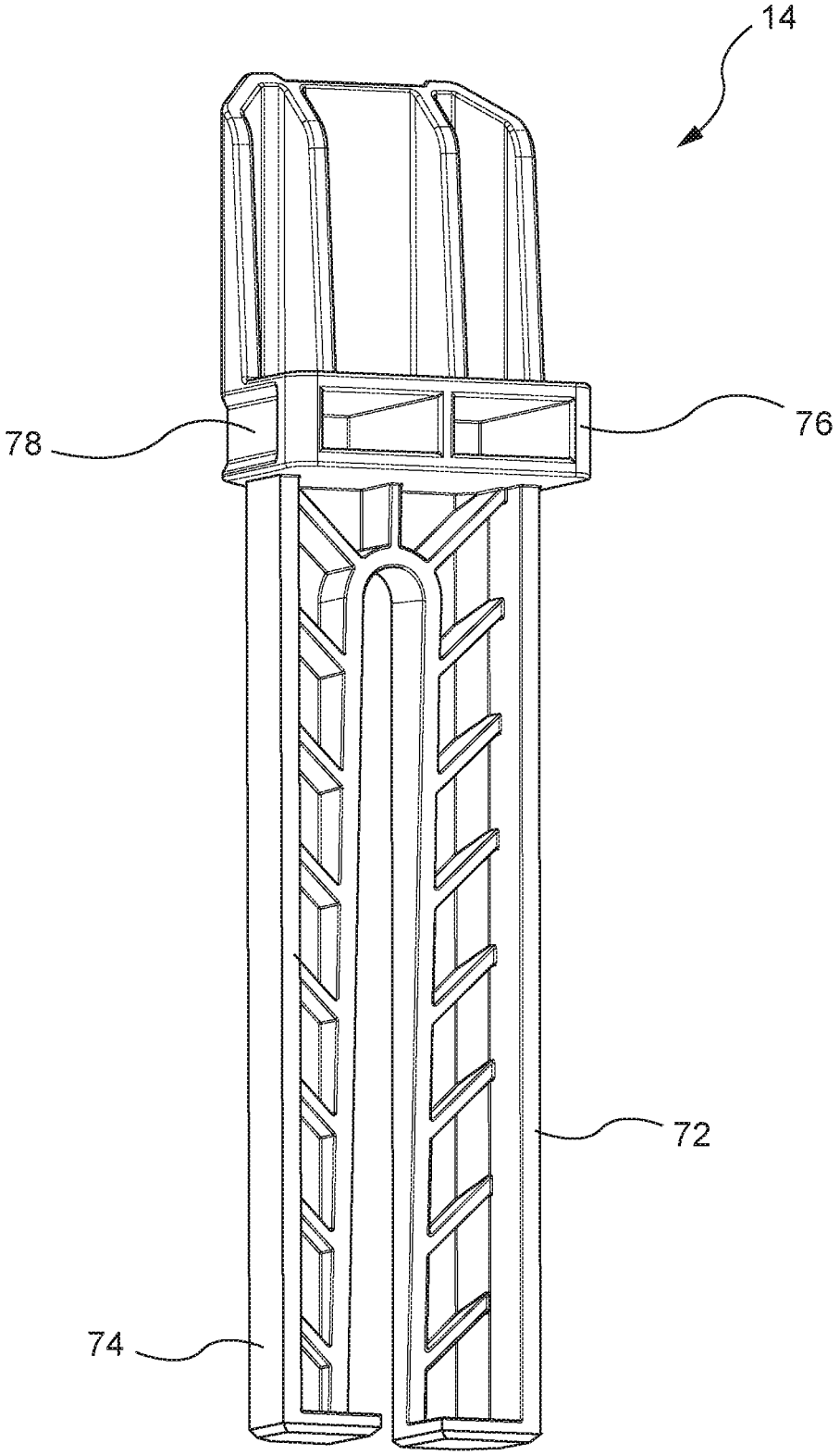
FIG. 9 is a rear perspective view of the support arm.
Figure 10:
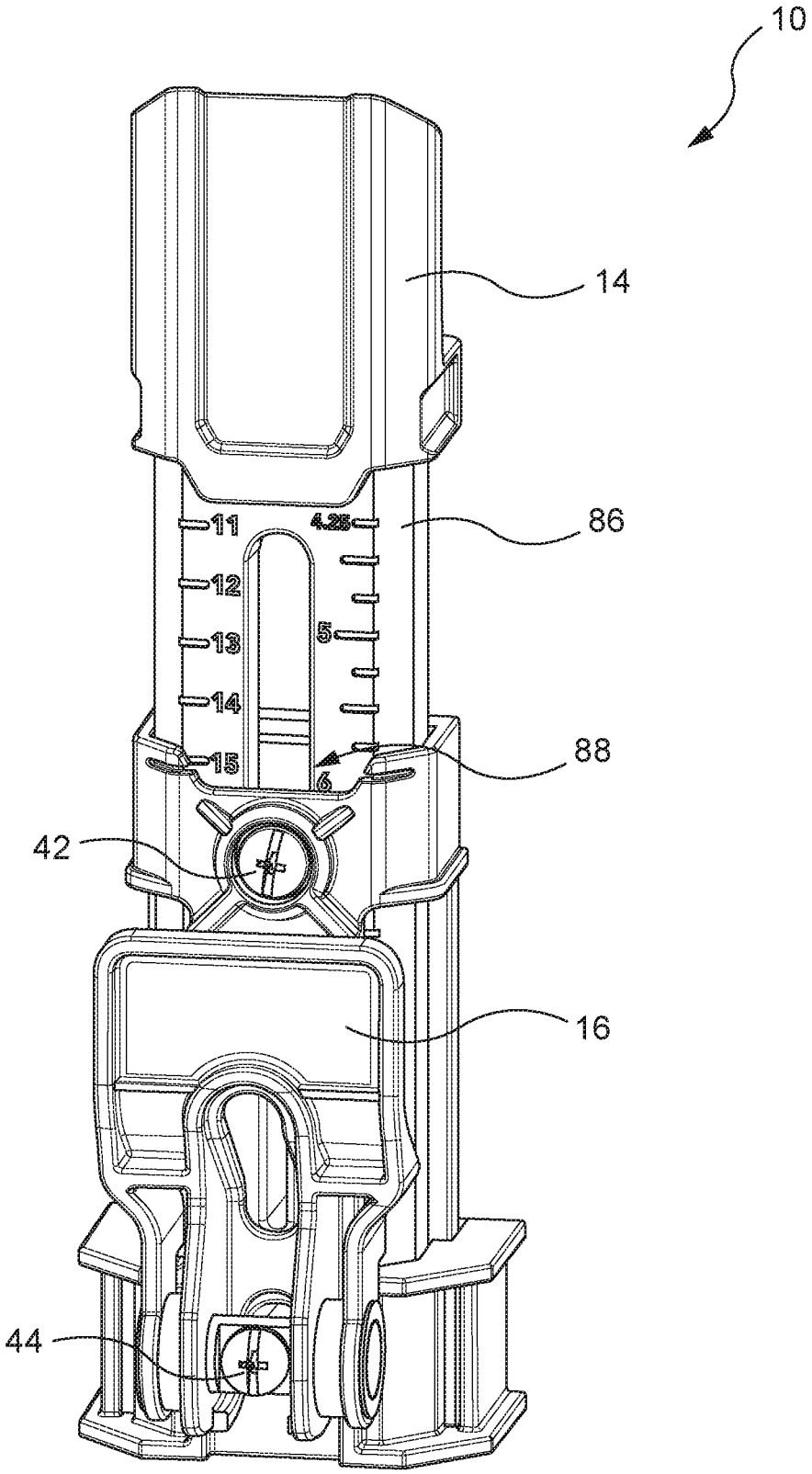
FIG. 10 is a perspective view of the siding gauge with a lever in a first position.
Figure 11:
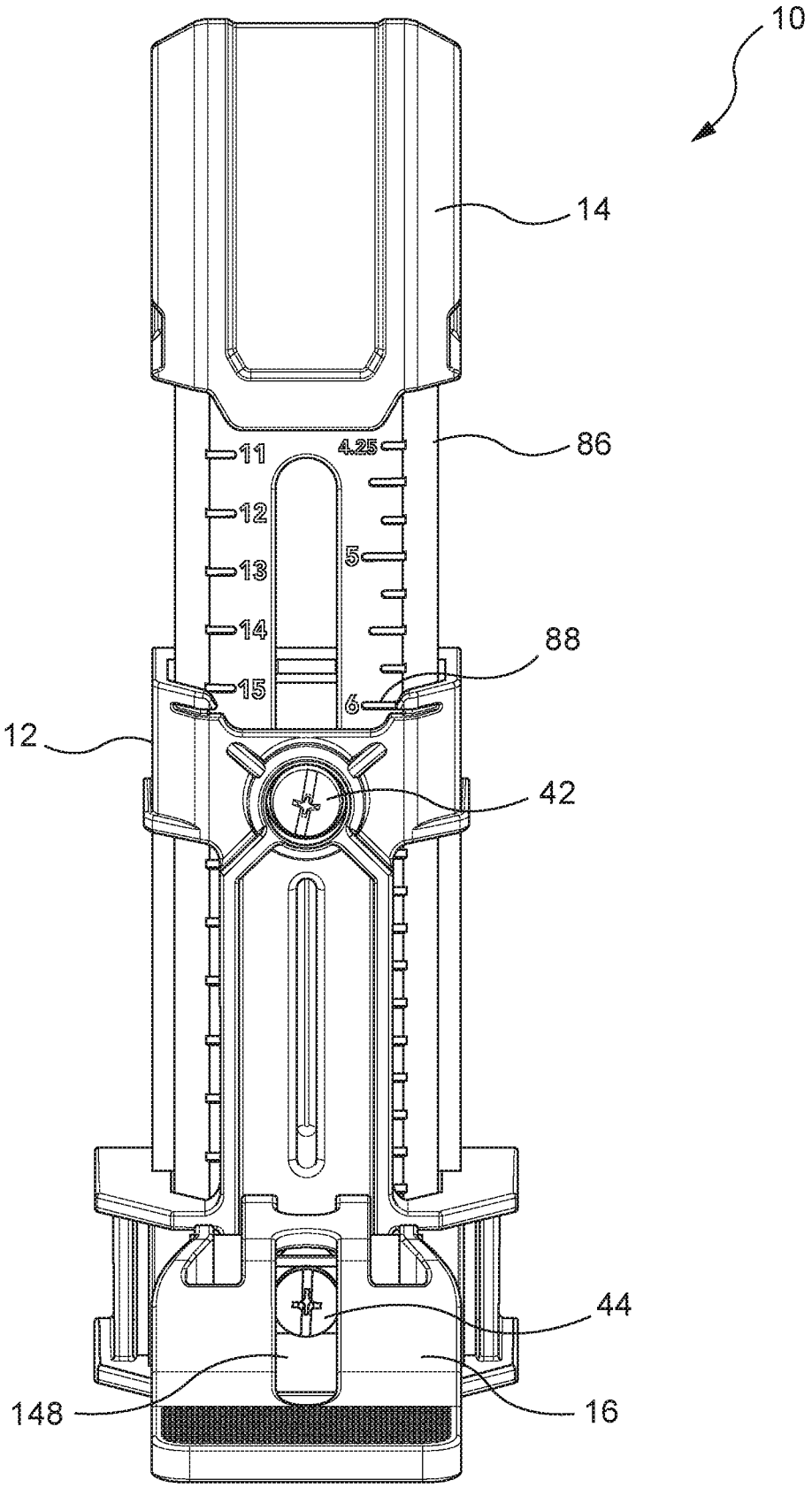
FIG. 11 is a perspective view of the siding gauge with the lever in a second position.
Figure 12:
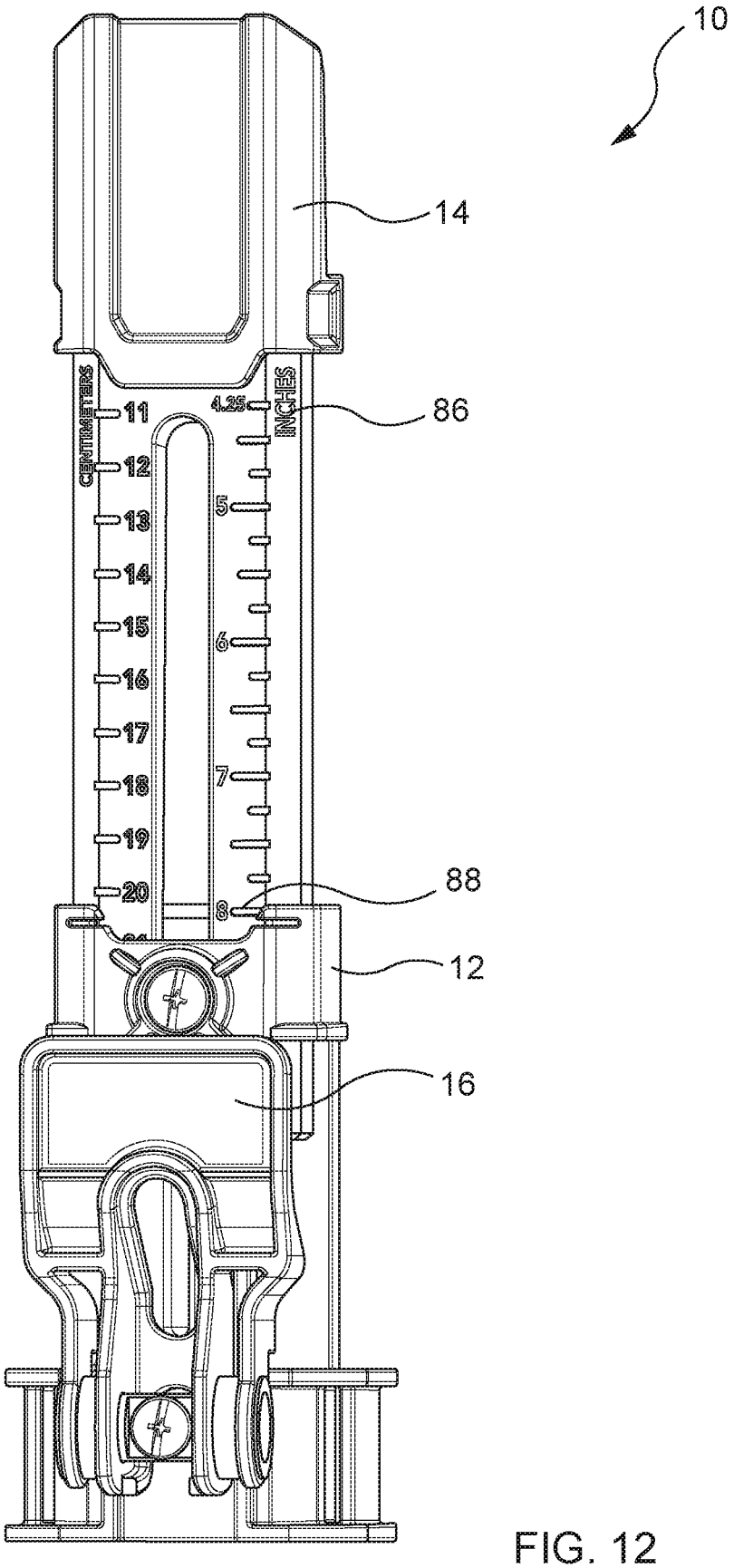
FIG. 12 is another perspective view of the siding gauge with the lever in the first position.

Turning additionally to FIGS. 7-12 and the support arm 14 in detail, the support arm 14 is continuously movable relative to the housing 12 through the passage 30 from the first position shown in FIG. 1 to a plurality of additional positions for use with siding of different heights or siding reveal, such as a second positon shown in FIGS. 10 and 11 indicating a six inch siding reveal and a third position shown in FIG. 12 indicating an eight inch siding reveal.

The support arm 14 includes a body 70 configured to abut a top of the housing 12 in a first position shown in FIG. 1 and a pair of legs 72 and 74 extending from the body 70 that are moveable through the passage 30 of the housing 12. The back of the body 70 serves as a tip prevention lip and includes a projection 76 extending from the bottom thereof to serve as a siding rest such that when the siding gauge 10 is installed on a piece of siding, a bottom of the next piece of siding being installed rests on the projection, and a front of the next piece of siding abuts the tip prevention lip. The sides of the projection can define grip areas 78 for a user to grip when adjusting the reveal height of the gauge.

The legs 72 and 74 are laterally spaced from one another to define a channel 80 that receives the guide 40 in the passage 30 of the housing 12. The front of each leg 72, 74 includes a plurality markings or indicia, such as a plurality of the indents 52 incrementally spaced from one another. For example, the leg 72 may include a plurality of indents 52 spaced from one another in centimeter increments with the unit of measure denoted by reference numeral 82 and markings or indicia, such as indents 84 denoting the number of centimeters of the siding reveal. Similarly, the leg 74 may include a plurality of indents 52 spaced from one another in inch increments with the unit of measure denoted by reference numeral 86 and markings or indicia, such as indents 88 denoting the number of inches of the siding reveal, with indents 90 serving as quarter inch increment indicators.

Figure 3:
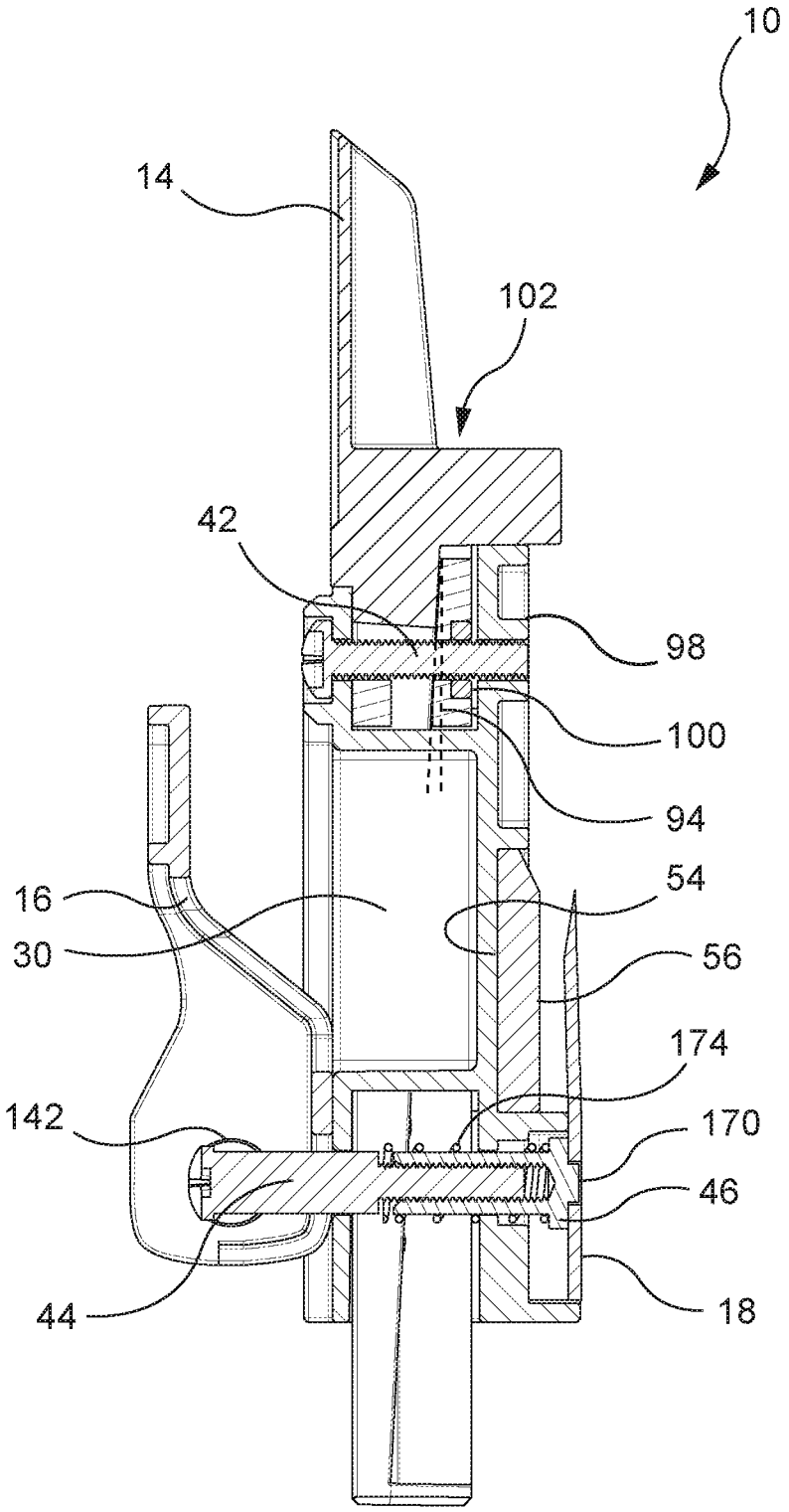
FIG. 3 is a cross-sectional view taken along line 3-3 in FIG. 2.
Figure 4:
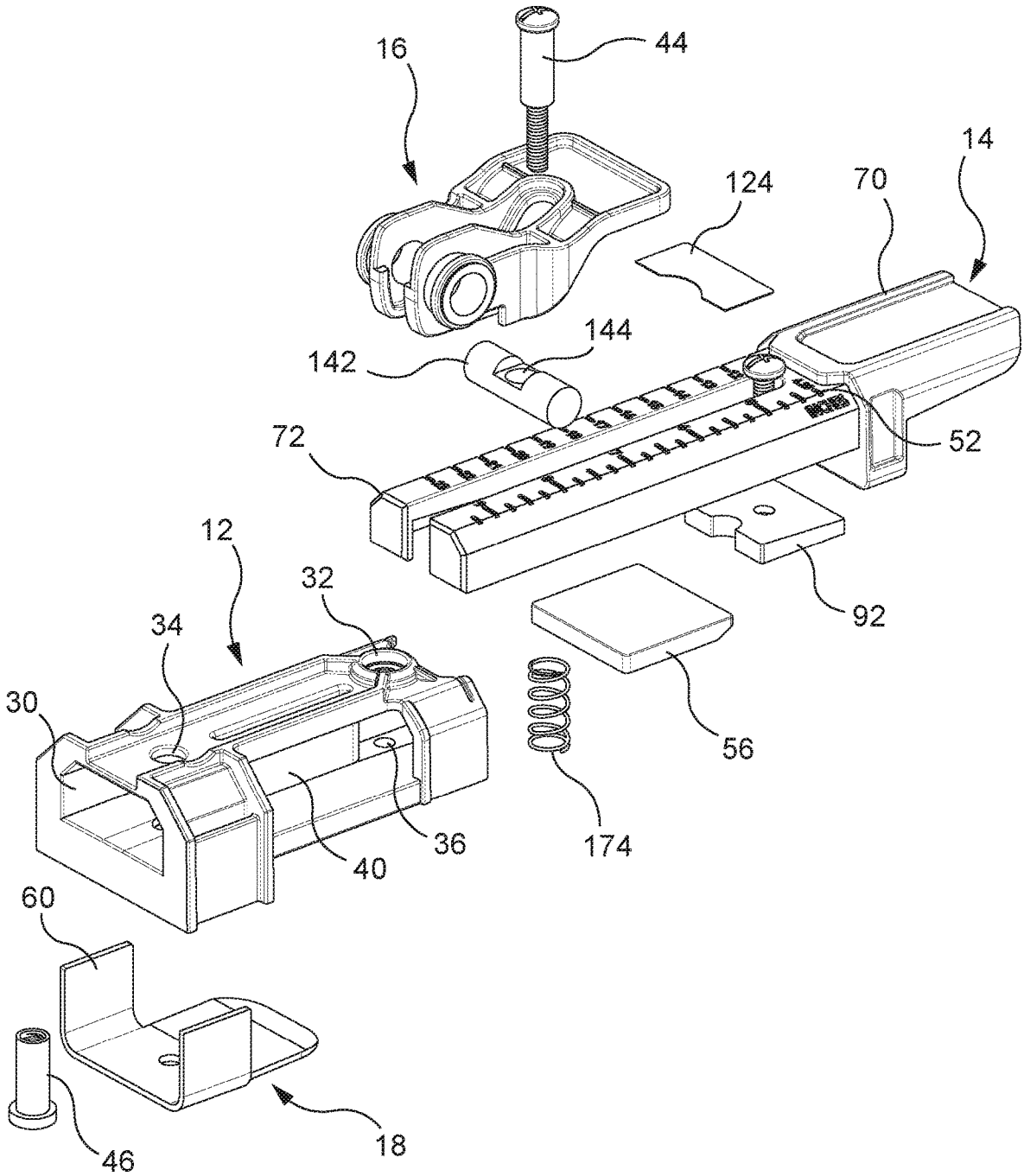
FIG. 4 is an exploded view of the siding gauge.

As best shown in FIGS. 3, 8 and 9, the inner surface of each leg 72, 74 that faces the other leg 72, 74 to define the channel 80 is angled from back to front such that a portion of each leg 72, 74 is thicker at its top than at its bottom. The backs of the legs 72 and 74 are configured to abut an angled surface of a pressure plate 92, which is angled to correspond to the angle of the legs 72 and 74 shown by reference numeral 94. The pressure plate 92 includes an opening 96 through which the first fastener 42 extends and defines a receptacle 98 on a backside thereof for receiving a lock nut 100 that engages the first fastener 42, such as via a threaded connection.

As the first fastener 42 is torqued down, the first fastener applies an axial force on the lock nut 100, which squeezes the support arm 14 between the pressure plate 92 and the housing 12, where the torque applied to the first fastener 42 is proportional to a clamping force. The interaction between the angled surface of the legs 72 and 74 and the angled surface of the pressure plate 92 increases the retention force of the first fastener 42 in a primary load direction shown at reference numeral 102, which eliminates or reduces slippage of the support arm 14 when loaded. The increased retention force allows for the use of non-metal components, such as plastic components, and allows for the use of fasteners that apply a lower torque, such as Philips head screws.

Figure 13:
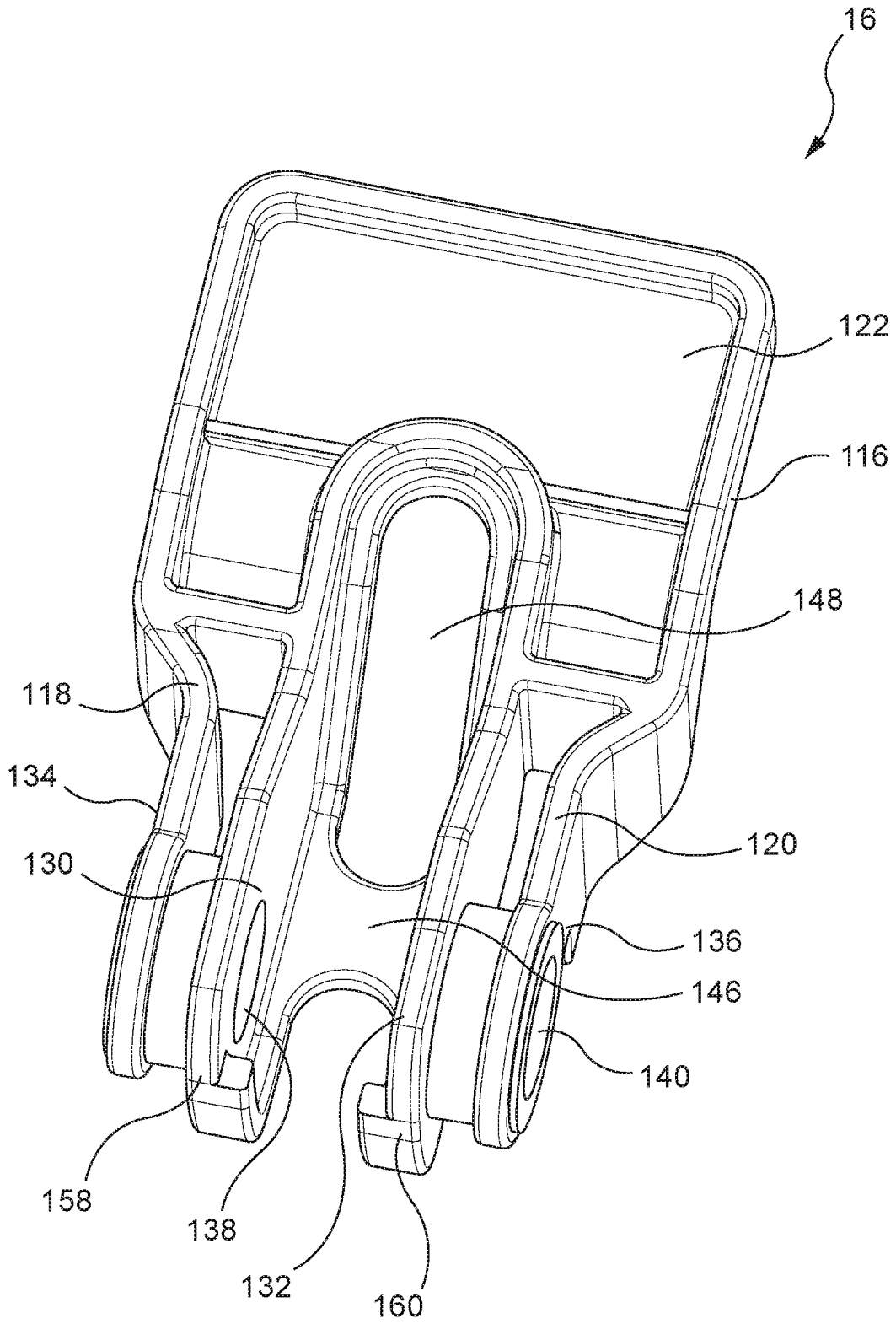
FIG. 13 is a front perspective view of the lever.
Figure 14:
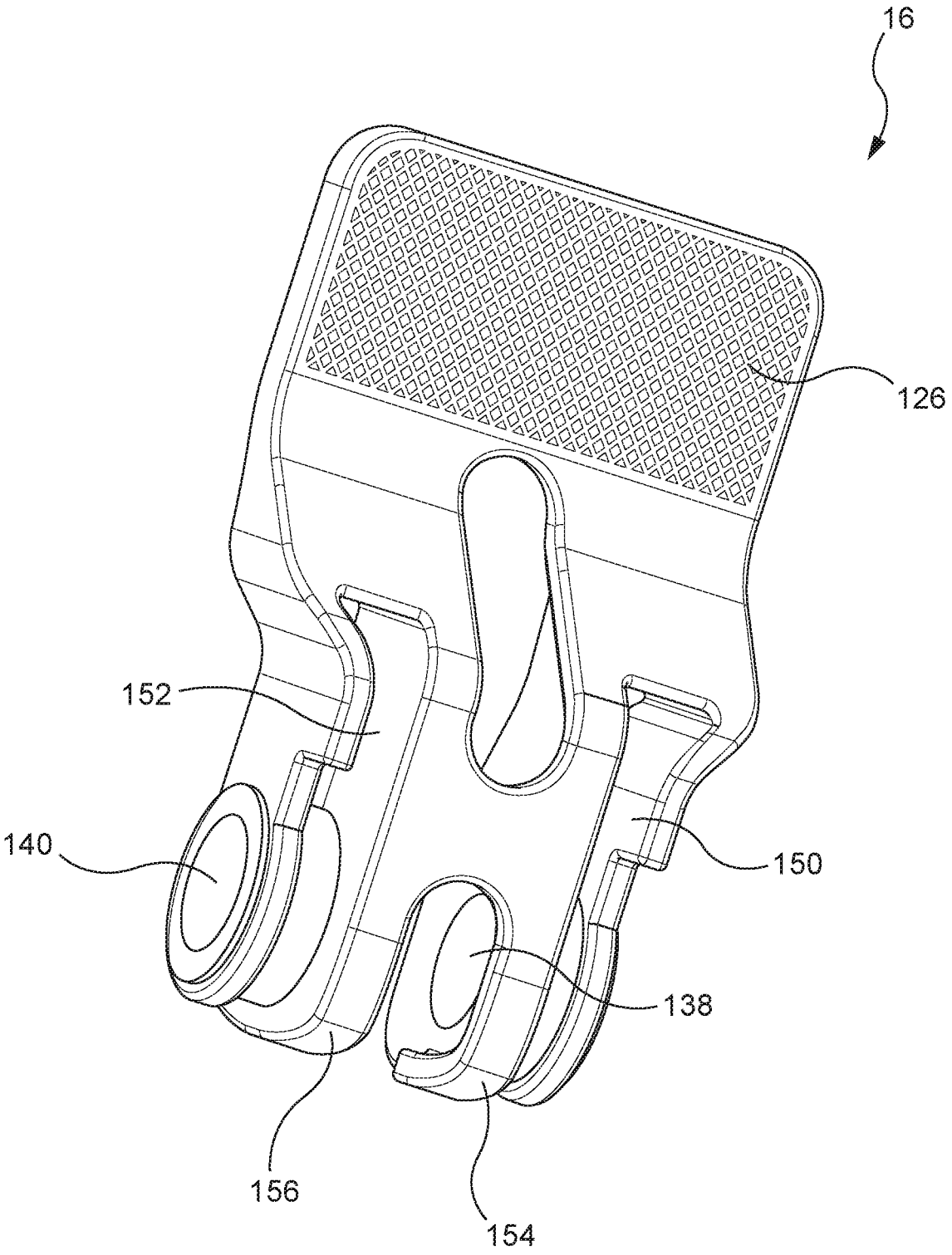
FIG. 14 is a rear perspective view of the lever.

Turning now to FIGS. 13 and 14, the lever 16 will be described in detail. The lever 16 is movable between a first upward closed position shown at reference numeral 110 in FIG. 1 and FIG. 10, an open position shown at reference numeral 112 in FIG. 1 and FIG. 11, and a second downward closed position shown at reference numeral 114 in FIG. 1. The lever 16 includes a body 116 for a user to grip and a pair of legs 118 and 120 extending from the body 116 and being laterally spaced from one another. The body 116 includes an area 122 on the front for receiving a label 124 or the like for including information on the product, and an area 126 on the back defining a grip area that may be textured to avoid slippage when gripped by the user.

Each leg 118, 120 has an inner portion 130, 132, and outer portion 134, 136, and a passage 138, 140 extending through the respective inner and outer portions 130, 132, 134, and 136 in a lateral direction for receiving a pin 142. The pin 142 includes an opening 144 for receiving the second fastener 44 to couple the lever 16 to the housing 12 and allow the lever 16 to pivot relative to the housing 12. The inner portions 130 and 132 are connected to one another by a joint 146, and define with the joint 146 and the body 116 an opening 148 that allows access to the second fastener 44 when the lever 16 is in the open position 112. The back each inner portion 130, 132 defines with the adjacent outer portion 134, 136 a channel 150, 152 for receiving a respective projection 64 on the front of the housing 12 when the lever 16 is in the first closed position 110. The back of each inner portion 130, 132 also has a cam surface 154, 156 that presses against the housing 12 in the first closed position 110 to pull the retention clip 18 toward the housing 12 to clamp down the gauge 10. Similarly, the front of each inner portion 130, 132 includes a cam surface 158, 160 that presses against the housing 12 in the second closed position 114 to pull the retention clip 18 toward the housing 12 to clamp down the gauge 10. When the lever 16 is in the open position 112, the head of the second fastener 44 will move toward the housing 12 to provide slack for positioning the siding gauge 10 on the siding. Once positioned, the lever 16 can be moved to the first or second closed position to clamp down on the siding.

Turning again to FIG. 4, to assemble the siding gauge 10, the first fastener 42 may be inserted through the first opening 32 in the housing 12 into the passage 30 and the pressure plate 92 and lock nut 110 positioned in the passage 30. The first fastener 42 is then inserted through the opening 96 in the pressure plate 92 and rotated clockwise to threadably engage the lock nut 110. The first fastener 42 may be further rotated until an end of the first fastener 42 extends through the third opening 36 in the housing 12. The pad 56 may be positioned in the cavity 54 on the back of the housing 12 and secured in a suitable manner, such as by an adhesive.

The pin 142 can be positioned in the passages 138 and 140 of the lever 16 with the opening 144 being positioned between the inner portions 130 and 132. The lever 16 can then be positioned near the housing 12 and the second fastener 44 inserted through the opening 144 in the pin 142 and the opening 34 in the housing 12. The fastener retainer 46 can be secured to the retention clip 18 or integrally formed therewith. For example, a projection 170 on the fastener retainer 46 can be received in an opening 172 in the retention clip 18 and secured in a suitable manner, such as by adhesive, welding, etc. A resilient member 174, such as a compression spring, can be positioned over the fastener retainer 46 and then the fastener retainer 46 inserted into the opening 38 in the housing 12. The second fastener 44 can then be coupled to the fastener retainer 46, for example by rotating the second fastener 44 clockwise to threadably engage the second fastener 44 and the fastener retainer 46. It will be appreciated that although described in a certain order above, the siding gauge 10 may be assembled in any suitable order.

Turning again to FIGS. 1, 10 and 11, operation of the siding gauge 10 will be described in detail. To adjust the reveal height, a user will loosen the first fastener 42 and move the support arm to the desired reveal height if known, for example a six inch reveal height, or the user can hold the siding gauge 10 up to a piece of siding and move the reveal arm to set the reveal height. The support arm 14 is continuously moveable in the passage 30 rather than being moved in preset increments. After the reveal height is set, the user tightens the first fastener 42, which applies an axial force on the lock nut 100, which squeezes the support arm 14 between the pressure plate 92 and the housing 12 to hold the support arm 14 at the desired reveal height and prevent slippage if there is a drop or high weight siding.

The user can then adjust the thickness of the siding gauge, or can adjust thickness prior to setting the reveal height. To adjust the thickness, the user loosens the second fastener 42 to increase the distance between the retention clip 18 and the housing 12, and then positions the siding gauge 10 on a piece of siding with the lever 16 in either of the first upward closed position or second downward closed position. The user then tightens the second fastener 42 as necessary until the siding gauge 10 is clamped on the siding. The user can then move the lever 16 to the open position creating slack to allow the siding gauge to be removed from the piece of siding. Alternatively, the user can loosen the second fastener 42 to increase the distance between the retention clip 18 and the housing 12, and then positions the siding gauge 10 on a piece of siding with the lever 16 in the open position. The user then tightens the second fastener 42 as necessary via the opening 148 to hold the siding between the retention clip 18 and housing 12, for example by hand tightening. When the user then positions the siding gauge 10 onto the siding, movement of the lever to either the first upward closed position or the second downward closed position will provide additional pressure to clamp the siding gauge to the siding.

Once the reveal height and thickness are set, the siding gauge can be positioned on a piece of siding with the lever 16 in the open position, and then the lever 16 moved to either the first upward closed position or second downward closed position, thereby clamping the siding gauge 10 onto the piece of siding and allowing another piece of siding to be installed.

The aforementioned systems, components, (e.g., gauges, handles, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

While the embodiments discussed herein have been related to the apparatus, systems and methods discussed above, these embodiments are intended to be exemplary and are not intended to limit the applicability of these embodiments to only those discussions set forth herein.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A siding gauge comprising:

a housing having a through passage extending along its length, a first opening in a front of the housing into the through passage, and a second opening in a rear of the housing into the through passage and aligned with the first opening;

a support arm movable relative to the housing in the through passage, the support arm including a body and a pair of legs extending from the body, the pair of legs being laterally spaced from one another to define a channel and each having an angled surface;

a fastener received in the first and second openings; and a pressure plate positioned in the through passage and coupled to the housing by the fastener, the pressure plate having an angled surface to correspond to the angled surface of the pair of legs, wherein interaction between the angled surface of each of the pair of legs and the angled surface of the pressure plate increases a retention force of the fastener in a primary load direction.

2. The siding gauge according to claim 1, wherein the pressure plate includes an opening for receiving the fastener and defines a receptacle on a backside thereof for receiving a lock nut that engages the fastener.

3. The siding gauge according to claim 2, wherein the fastener is configured to apply an axial force on the lock nut when a torque is applied to press the support arm between the pressure plate and the housing to increase the retention force.

4. The siding gauge according to claim 1, wherein each of the pair of legs has an inner surface that faces the inner surface of the other leg to define the channel, wherein each inner surface forms the angled surface.

5. The siding gauge according to claim 4, wherein each inner surface is thicker at its top than at its bottom, and wherein the pressure plate is thicker at its bottom than at its top.

6. The siding gauge according to claim 1, further comprising a retention clip coupled to the housing and movable relative to the housing for adjusting for siding thickness.

7. The siding gauge according to claim 1, further including a lever pivotable relative to the housing.

8. The siding gauge according to claim 7, wherein the housing includes a third opening in the front of the housing into the through passage and a fourth opening in the rear of the hosing into the through passage and aligned with the third opening, wherein the siding gauge further includes a second fastener received in the third and fourth openings for pivotally coupling the lever to the housing.

9. The siding gauge according to claim 7, wherein the housing, support arm, and lever are plastic.

10. The siding gauge according to claim 1, wherein a front of at least one of the pair of legs of the support arm includes a plurality of markings incrementally spaced from one another for setting a reveal height.

11. The siding gauge according to claim 10, wherein the front of the housing has at least one marking for aligning with one of the plurality of markings on the support arm for indicating the reveal height.

12. A siding gauge comprising:

a housing having a through passage extending along its length;

a support arm movable relative to the housing in the through passage for adjusting a reveal height; and a lever pivotable relative to the housing, the lever movable between a first upward closed position to clamp the siding gauge against the siding, a second downward closed position to clamp the siding gauge against the siding, and an open position between the first upward closed position and the second downward closed position to provide slack for positioning the siding gauge.

13. The siding gauge according to claim 12, wherein the lever includes a body for a user to grip and a pair of legs extending from the body and being laterally spaced from one another.

14. The siding gauge according to claim 13, wherein a back of each leg includes a cam surface that presses against the housing in the first upward closed position and a front of each leg includes a cam surface that presses against the housing in the second downward closed position.

15. The siding gauge according to claim 12, further comprising a rubber pad, wherein a back of the housing includes a cavity for receiving the rubber pad, and wherein the rubber pad is configured to deform when the lever is moved to one of the first upward closed position or the second downward closed position.

16. The siding gauge according to claim 12, wherein the housing has a first opening in a front of the housing into the through passage, a second opening in the front of the housing into the through passage, a third opening in a rear of the housing into the through passage and aligned with the first opening, and a fourth opening in the rear of the housing into the through passage and aligned with the second opening, and wherein the siding gauge further includes a first fastener received in the first and third openings for adjusting a reveal height of the support arm, and a second fastener received in the second and fourth openings for pivotally coupling the lever to the housing.

17. The siding gauge according to claim 12, wherein the support arm including a body and a pair of legs extending from the body, the pair of legs being laterally spaced from one another to define a channel and each having an angled surface.

18. The siding gauge according to claim 17, further including a pressure plate positioned in the through passage and coupled to the housing, the pressure plate having an angled surface to correspond to the angled surface of the pair of legs, wherein interaction between the angled surface of each of the pair of legs and the angled surface of the pressure plate increases a retention force of the fastener in a primary load direction.

19. A siding gauge comprising:

a housing having a through passage extending along its length, a first opening in a front of the housing into the through passage, a second opening in the front of the housing into the through passage, a third opening in a rear of the housing into the through passage and aligned with the first opening, and a fourth opening in the rear of the housing into the through passage and aligned with the second opening;

a support arm movable relative to the housing in the through passage, the support arm including a body and a pair of legs extending from the body, the pair of legs being laterally spaced from one another to define a channel;

a lever pivotable relative to the housing;

a retention clip coupled to the housing and movable relative to the housing for adjusting for siding thickness;

a first fastener received in the first and third openings for adjusting a reveal height of the support arm; and a second fastener received in the second and fourth openings for pivotally coupling the lever to the housing.

20. The siding gauge according to claim 19, further including a pressure plate positioned in the through passage and coupled to the housing by the first fastener, wherein each of the pair of legs of the support arm has an angled surface and wherein the pressure plate is angled to correspond to the angled surface of the pair of legs.

* * * * *